US006655185B2

(12) United States Patent
Uegaki

(10) Patent No.: US 6,655,185 B2
(45) Date of Patent: Dec. 2, 2003

(54) VEHICLE REPAIRING DEVICE

(76) Inventor: Tateo Uegaki, 8-3, Sakae 1-chome, Miyagino-ku, Sendai-shi, Miyagi 983-0011 (JP)

( * ) Notice: Subject to any disclaimer, the term of this patent is extended or adjusted under 35 U.S.C. 154(b) by 0 days.

(21) Appl. No.: 09/958,428

(22) PCT Filed: Feb. 9, 2001

(86) PCT No.: PCT/JP01/00959

§ 371 (c)(1),
(2), (4) Date: Oct. 9, 2001

(87) PCT Pub. No.: WO01/58614

PCT Pub. Date: Aug. 16, 2001

(65) Prior Publication Data

US 2003/0070470 A1 Apr. 17, 2003

(30) Foreign Application Priority Data

Feb. 9, 2000 (JP) ..... 2000-032515

(51) Int. Cl.[7] ..... B21D 1/12
(52) U.S. Cl. ..... 72/391.2; 72/705
(58) Field of Search ..... 72/391.2, 705

(56) References Cited

U.S. PATENT DOCUMENTS

| | | | | |
|---|---|---|---|---|
| 3,712,106 A | | 1/1973 | Holsapple et al. | |
| 3,955,397 A | * | 5/1976 | Meis | 72/705 |
| 4,057,994 A | * | 11/1977 | Wolgast et al. | 72/705 |

FOREIGN PATENT DOCUMENTS

| | | |
|---|---|---|
| EP | 0 783 926 A1 | 7/1997 |
| EP | 0 856 366 A2 | 8/1998 |
| JP | 50 100748 | 8/1975 |
| JP | 51 19443 | 2/1976 |
| JP | 56 91621 | 7/1981 |
| JP | 5 84411 | 11/1993 |
| JP | 09020214 A | 1/1997 |
| JP | 10167028 A | 6/1998 |

OTHER PUBLICATIONS

Supplementary European Search Report for European Application No. 01904378.5, completed May 12, 2003 (mailed May 22, 2003).

* cited by examiner

*Primary Examiner*—Lowell A. Larson
(74) *Attorney, Agent, or Firm*—Alston & Bird LLP

(57) ABSTRACT

The present invention aims to provide a vehicle repairing device capable of pulling out a damaged portion to a predetermined position safely and easily. A device for pulling out a damaged portion of a panel surface to a normal position includes a first puller having a first fixing portion to be fixed to the damaged portion and adapted to pull up the first fixing portion in a state in which it is fixed to a predetermined range of the damaged portion, and a second puller having a second fixing portion to be fixed to the damaged portion and adapted to pull up the second fixing portion in a state in which it is further locally fixed to the damaged portion of the panel surface to be pulled up by the first puller.

11 Claims, 20 Drawing Sheets

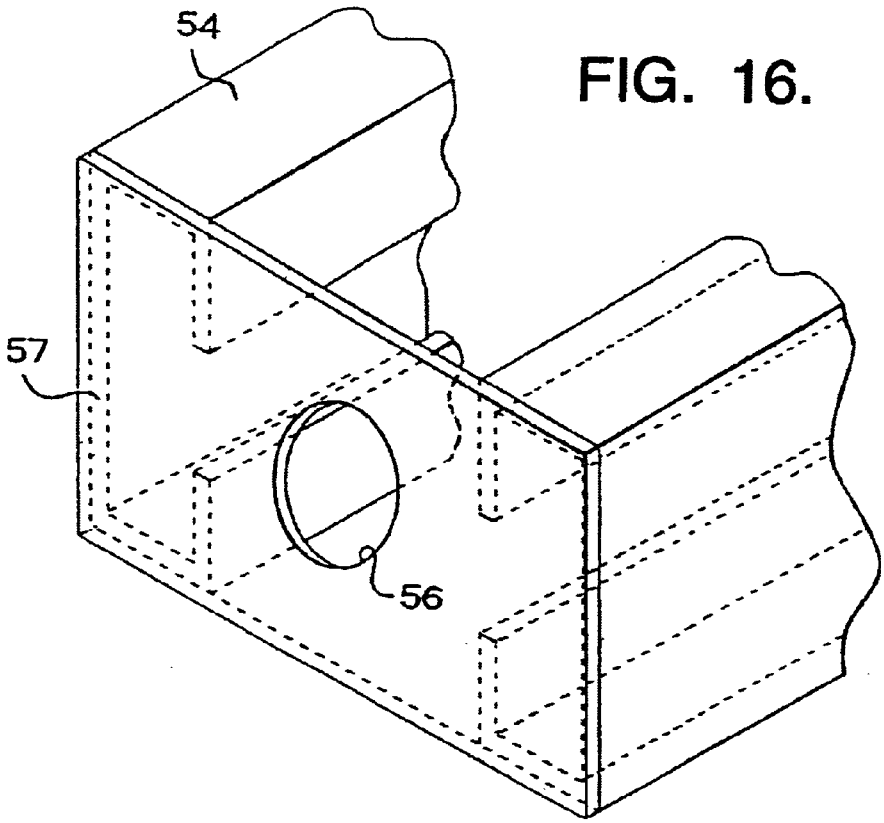
FIG. 16.
FIG. 17.
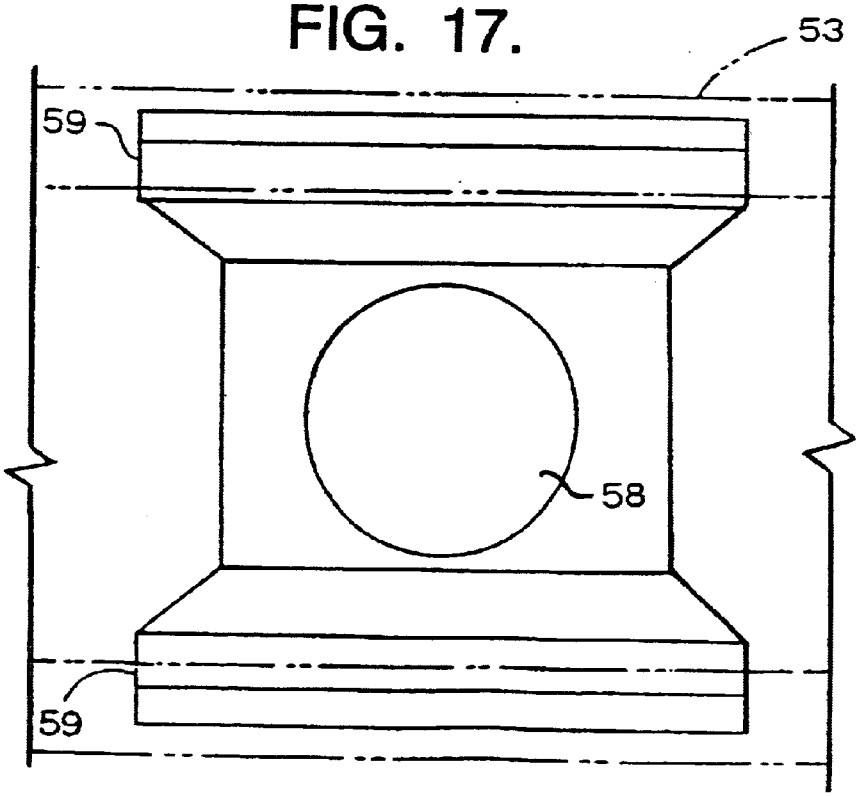

VEHICLE REPAIRING DEVICE

TECHNICAL FIELD

The present invention relates to a vehicle repairing device for restoring a damaged panel surface of a vehicle to the normal configuration.

BACKGROUND ART

Conventional vehicle repairing devices for use in sheet metal repairing for restoring a damaged portion in a panel surface of a vehicle to the normal position include a sliding hammer 200 as shown in FIG. 21 and a power lock stand device as shown in FIG. 22.

The sliding hammer 200 is a tool including an iron shaft 201 formed as an integral unit having at one end a hook 204 and at the other end an iron grip portion 203, and a counter weight 202 provided so as to be slidable on the shaft 201. It is used for a damaged portion of a relatively small area.

The sliding hammer 200 is used as follows: the hook 204 provided at one end of the shaft 201 is hooked on to a weld washer W welded to a damaged portion D beforehand, and the grip portion 203 is held by one hand. Subsequently, the counter weight 202 slidably provided on the shaft 201 is slid to be banged against the grip portion 203 to thereby pull out the damaged portion D. That is, the inertial energy of the counter weight 202 is transmitted by way of the grip portion 203, the shaft 201, the hook 204, and the damaged portion D to thereby pull out the damaged portion D toward the operator side. When this sliding hammer is used, great energy is instantaneously applied to the damaged portion. As a result, the damaged portion D is locally pulled out.

The power lock stand device 300 includes a chain 302 stretched between the damaged portion D and the floor surface in proximity of the damaged portion D through the intermediation of a chain block 301, and a stand 303 for determining the direction (height) in which the damaged portion D is pulled out while maintaining a part of the stretched chain 302 at a fixed height. It is applied to a damaged portion of a relatively large area.

The chain block 301 is a device includes a main body portion having a hook, a chain provided in the main body portion, and a take-up device for the chain. By operating the take-up device, it is possible to arbitrarily reduce the chain length.

The power lock stand device 300 is operated as follows: first, a hook of the chain block 301 is hooked on to a weld washer W welded to the damaged portion D beforehand. Then, the chain 302 is stretched between the floor surface in proximity of the damaged portion D and the chain block 301. At this time, the stand 303 is arranged such that a part of the stretched chain 302 is maintained at the same height as the damaged portion D. Then, the chain block 301 is operated to gradually reduce the entire length of the chain 302 stretched, thereby making it possible to pull out the damaged portion to the normal position. When the power lock stand device is used, a force is gradually applied to the damaged portion, so that the damaged portion is pulled back in its entirety.

In some cases, a damaged portion in the panel surface of a vehicle consists of a large distortion with a small dent existing locally therein. Conventionally, such a damaged portion is first pulled out in its entirety by using a power lock stand device, and then the local dent is pulledback by using a sliding hammer.

It is also possible to increase the number of weld washers welded to the damaged portion beforehand and to use the above two devices simultaneously. In that case, however, it is difficult to weld the weld washers to optimum positions. Further, if the two devices can be appropriately installed, these is a danger of the weld washers which the power lock stand device uses being detached due to the impact of the sliding hammer.

In view of this, in the conventional sheet metal repair technique, the repair operation has to be conducted while interchanging the two devices, resulting in a bother for the operator Further, the repairing operation takes a lot of time.

The present invention has been made in view of the above problems in the prior art. It is an object of the present invention to provide a vehicle repairing device, which is capable of pulling out a damaged portion safely and easily. Another object of the present invention is to provide a vehicle repairing device capable of pulling out a damaged portion to a predetermined position in a short time.

DISCLOSURE OF THE INVENTION

In accordance with the present invention, there is provided a vehicle repairing device for pulling out a damaged portion of a panel surface to a normal position, including a first puller having a first fixing portion to be fixed to the damaged portion and adapted to pull up the first fixing portion in a state in which it is fixed to a predetermined range of the damaged portion, and a second puller having a second fixing portion to be fixed to the damaged portion and adapted to pull up the second fixing portion in a state in which it is further locally fixed to the damaged portion of the panel surface to be pulled up by the first puller.

In the present invention, the first fixing portion may include an attachment pad or covering the damaged portion of the panel surface to be pulled up by the first puller, and a pressure reducing means for reducing the pressure of the interior if the attachment pad.

In the present invention, the second fixing portion may include a weld member to be welded to the damaged portion of the panel surface, and a holder for holding the weld member.

Further, in the present invention, there may be provided a puller main body equipped with a hollow shaft, a slide rod slidably provided inside the hollow shaft, a first ascent/descent device pulling up the hollow shaft, and a second ascent/descent device pulling up the slide rod, wherein the first fixing portion is provided at one end of the hollow shaft, wherein the second fixing portion is provided at one end of the slide rod, and wherein the second fixing portion is provided so as to protrude into the interior of the first fixing portion provided at one end of the hollow shaft.

Further, there may be provided a holding portion for holding the puller main body so as to make it perpendicular to the damaged portion of the panel surface, wherein the holding portion holds the puller main body at one point in the axial direction thereof, and wherein one end of the puller main body is movable in all directions by using the one point in the axial direction at which it is held by the holding portion as a fulcrum.

At least one of the first ascent/descent device and the second ascent/descent device may include a rack gear extending along an outer peripheral surface of the hollow shaft or the slide rod and in the axial direction thereof, a pinion gear engaged with the rack gear, an engagement pawl engaged with the pinion gear and restricting the rotating direction thereof, an ascent/descent device main body which contains the pinion gear and the engagement pawl and which is supported at a predetermined support point and a rotating means for rotating the pinion gear.

Further, in the present invention, there may be provided a supporting device for supporting the puller main body, wherein the supporting device has a longitudinal rail and a lateral rail slidably provided on the longitudinal rail, and wherein the holding portion is slidably held by the lateral rail.

In accordance with the present invention, it is possible to pull out a damaged portion in a damage state in which a small dent locally exists in a large distortion to a predetermined position safely and easily.

Further, it is possible to pull out a damaged portion in a damage state in which a small dent locally exists in a large distortion by a single device, so that the operator is spared the trouble of interchanging a plurality of devices. Further, the requisite time for the repair can be substantially reduced.

Further, when there is provided a supporting device capable of supporting the puller main body at any angle and any position near the damaged portion, it is possible to pull out the damaged portion in a desired direction, making it possible to obtain a metal sheet repaired surface extremely approximate to the normal configuration.

BRIEF DESCRIPTION OF THE DRAWINGS

FIG. 16 is a perspective view showing a portion in the vicinity of an end portion of a lateral rail according to an embodiment of the present invention;

FIG. 17 is a front view showing a lateral rail retaining bracket according to an embodiment of the present invention;

BEST MODE FOR CARRYING OUT THE INVENTION

Figure 1:
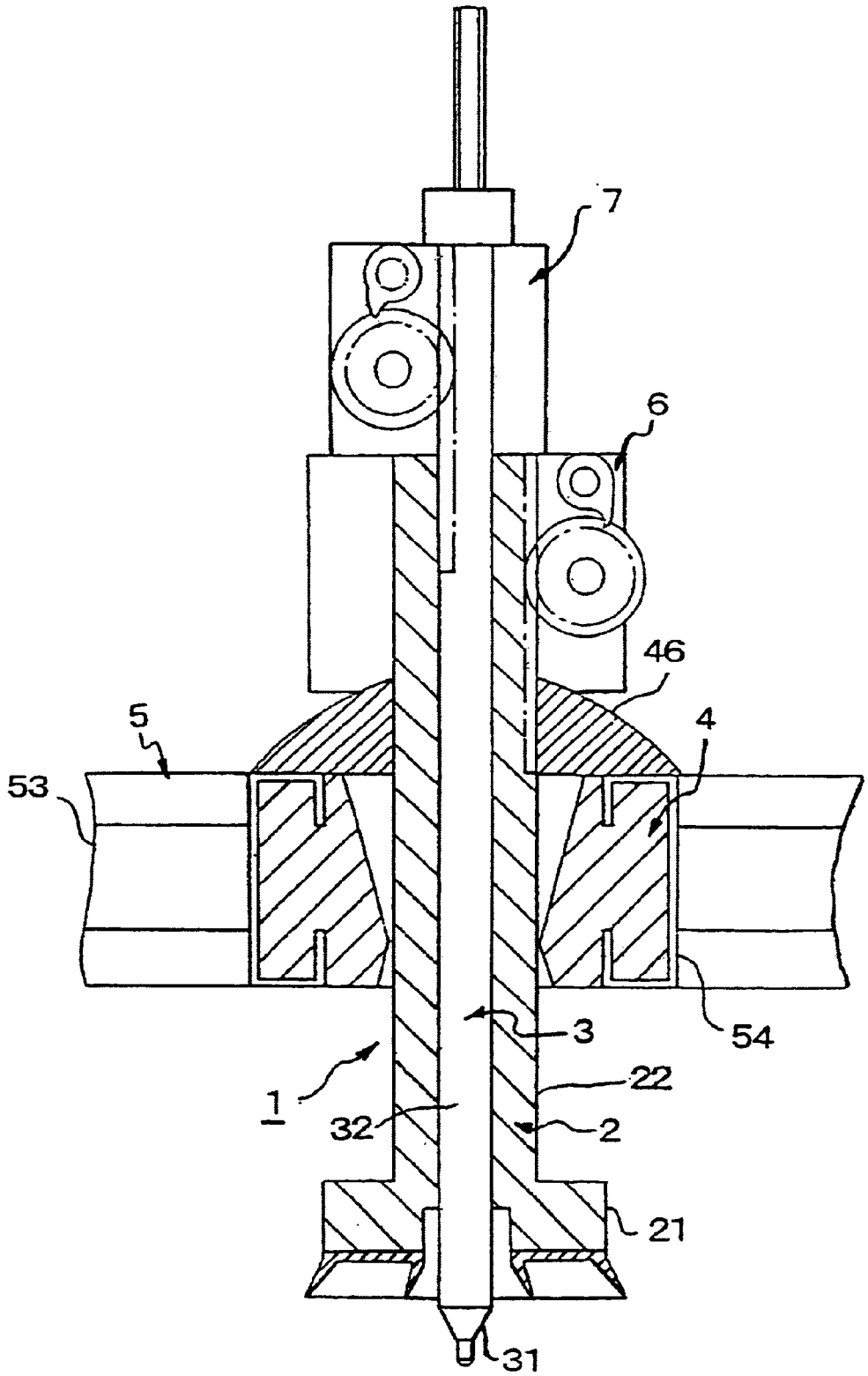
FIG. 1 is a sectional view of a vehicle repairing device according to an embodiment of the present invention.

An embodiment of the present invention will now be described in detail with reference to the drawings.

Schematically, a vehicle repairing device according to this embodiment includes a puller main body 1 equipped with a first puller 2 and a second puller 3 integrated with each other, a holding portion 4 holding the puller main body 1 so as to be perpendicular to a damaged portion of a panel surface (hereinafter simply referred to as the damaged portion), and a support device 5 capable of moving the holding portion 4 in plane-matrix directions with respect to the damaged portion.

The first puller 2 is composed of a first fixing portion 21 for fixing (holding) the damaged portion in a predetermined range, a metal hollow shaft 22 having the first fixing portion 21 on its lower end side, and a first ascent/descent device 6 for raising the hollow shaft 22 using the holding portion 4 as a fulcrum.

Here, the lower end of the hollow shaft 22 means an end portion facing the panel surface of the vehicle when the vehicle repairing device of this embodiment is being used. In the following, the terms below, lower end, lower surface, etc. always indicate a direction to the vehicle panel surface (damaged portion).

Figure 3:
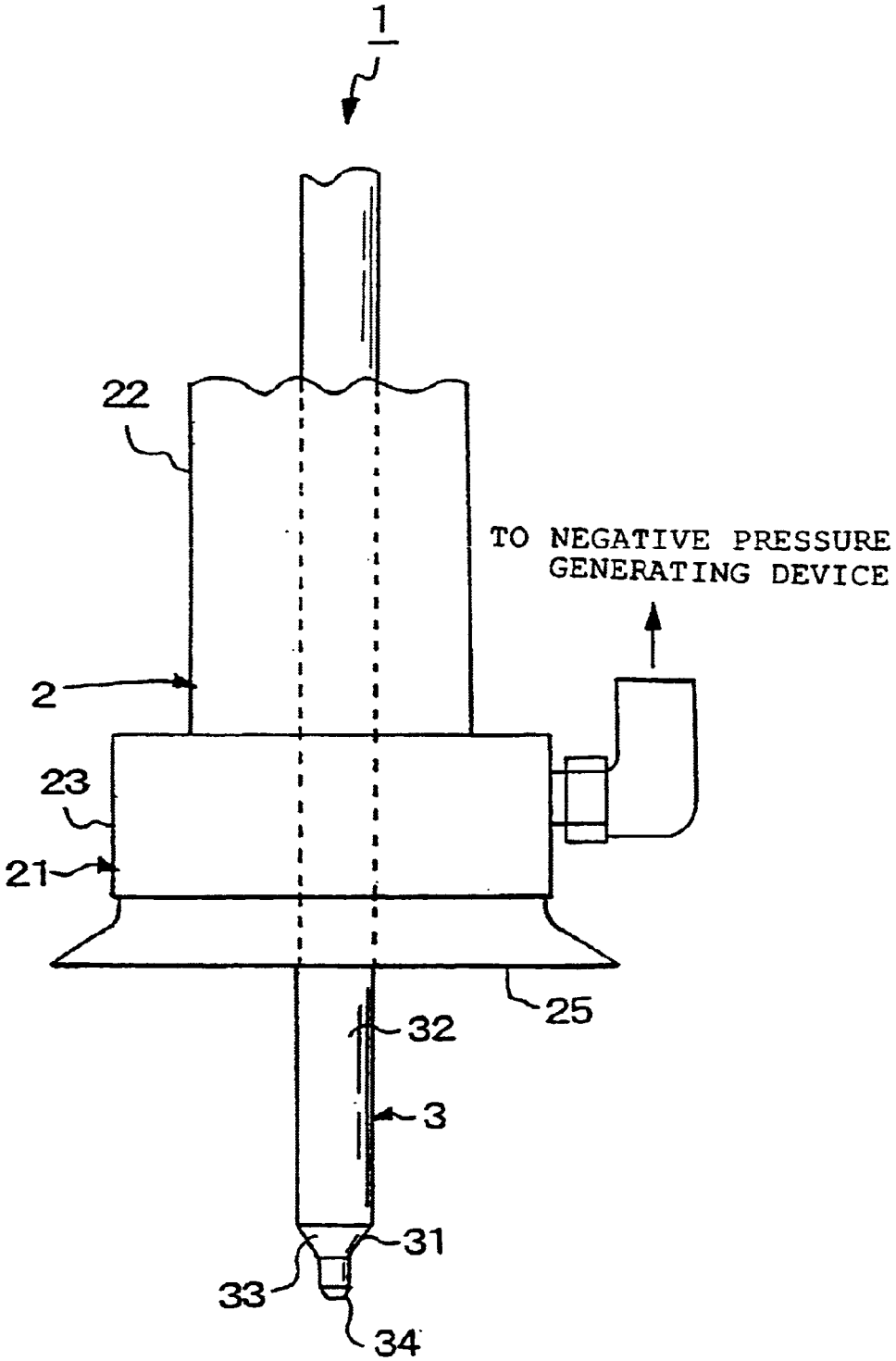
FIG. 3 is a front view showing a main portion of a puller main body according to an embodiment of the present invention.
Figure 4:
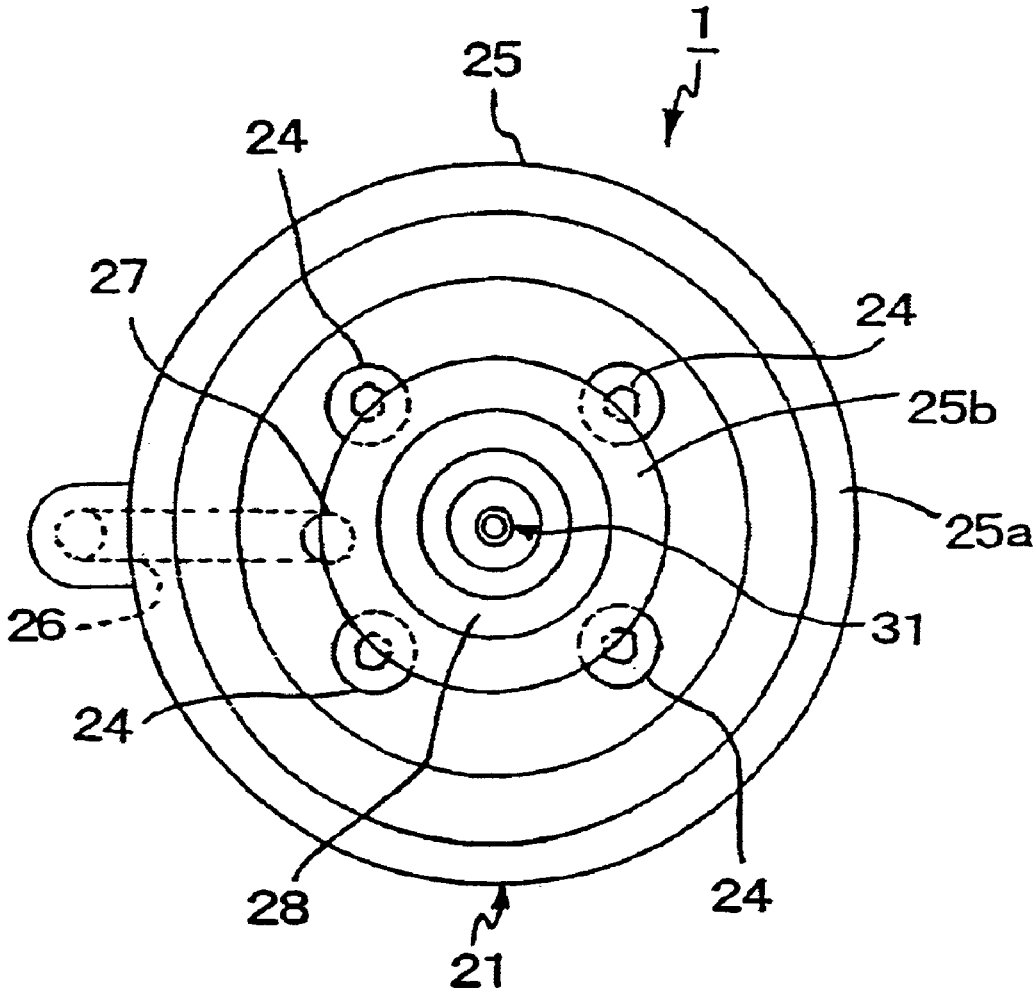
FIG. 4 is a bottom view of a puller main body according to an embodiment of the present invention.
Figure 5:
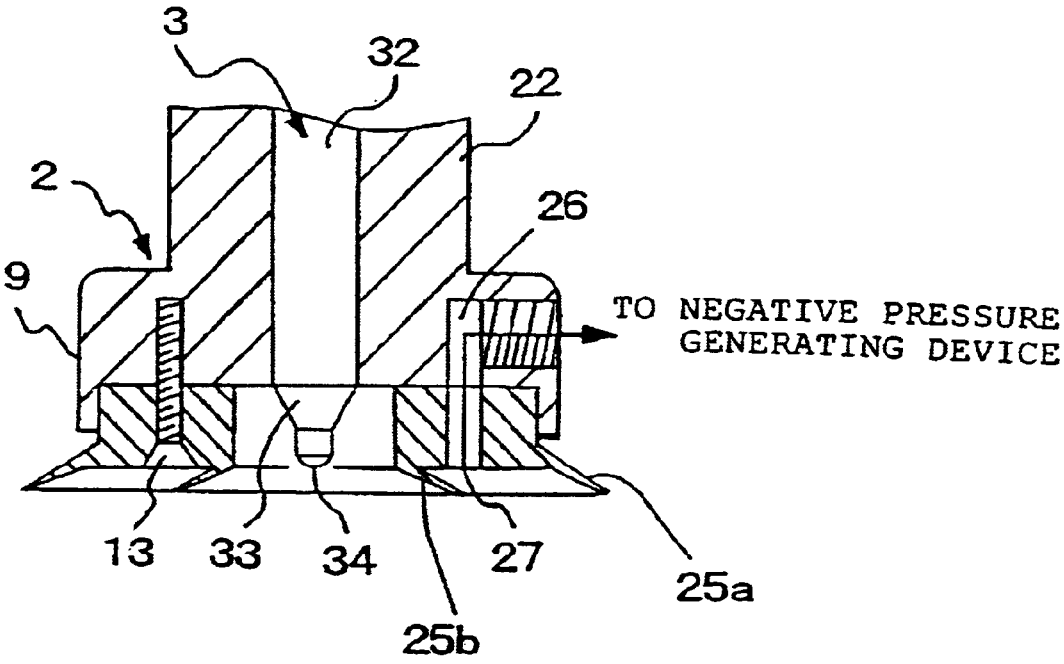
FIG. 5 is a sectional view of a puller main body according to an embodiment of the present invention.

As shown in FIGS. 3 through 5, the first fixing portion 21 is composed of a cylindrical main body portion 23, a duplex attachment pad 25 fastened to the lower surface of the main body portion 23 by means of a plurality of bolts 24, and an intake passage 26 one end of which opens on the inner side of the attachment pad 25 and the other end of which is connected to a negative pressure generating device equipped with a negative pressure source (not shown). In FIG. 5, reference numeral 27 indicates an opening of the intake passage 26 one end of which communicates with the inner side of the attachment pad 25.

The attachment pad 25 is of a duplex structure composed of an outer attachment pad 25*a* and an inner attachment pad 25*b*. Then, when the negative pressure generating device is operated, with the attachment pad 25 being pressed against the damaged portion, the pressure of the space surrounded by the outer attachment pad 25*a* and the inner attachment pad 25*b* is reduced by the negative pressure, and the damaged portion is firmly fixed (held) by the first fixing portion 21 in an area corresponding to a diameter of the attachment pad 25.

The attachment pad 25 is of two types: circular and elliptical, the appropriate one of which is used according to the area and the configuration of the damaged portion. When replacing the attachment pad 25, the bolts 24 for fixing the attachment pad 25 to the main body portion 23 are removed. Thus, in this embodiment, a suction device for holding the damaged portion by utilizing negative pressure is adopted as the first fixing portion 21.

It is also possible to form the main body portion 23 and the attachment pad 25 by using a transparent material. Further, it is possible to provide an inspection window in the main body portion 23. In this case, the condition in the first fixing portion 21 can be ascertained, making it possible to perform a more accurate pulling-out operation. Examples of the transparent material include a resin material, such as acrylic resin.

Then, at the center on the upper surface side of the main body portion 23, there is provided a metal hollow shaft 22 to be raised by the first ascent/descent device 6. Further, a second puller through-hole 28 communicating with the interior of the hollow shaft 22 is provided in the main body portion 23 and the attachment pad 25, and a second puller 3 which is concentric with the first puller 2 is provided so as to extend through the interior of the second puller through-hole 28 and the hollow shaft 22.

As shown in FIG. 5, the second puller 3 does not directly extend through the attachment pad 25, so that even in the state in which the second puller 3 is provided, the sucking force of the first fixing portion 21 is not impaired. Further, it is not always necessary for the attachment pad 25 to have a duplex structure. It may also be formed solely by the outer attachment pad 25*a*. In this case, when the clearance between the second puller 3 and the second puller through-hole 28 is made sufficiently small, the sucking force of the first fixing portion 21 is not impaired, making it possible to reliably fix the damaged portion.

Figure 11:
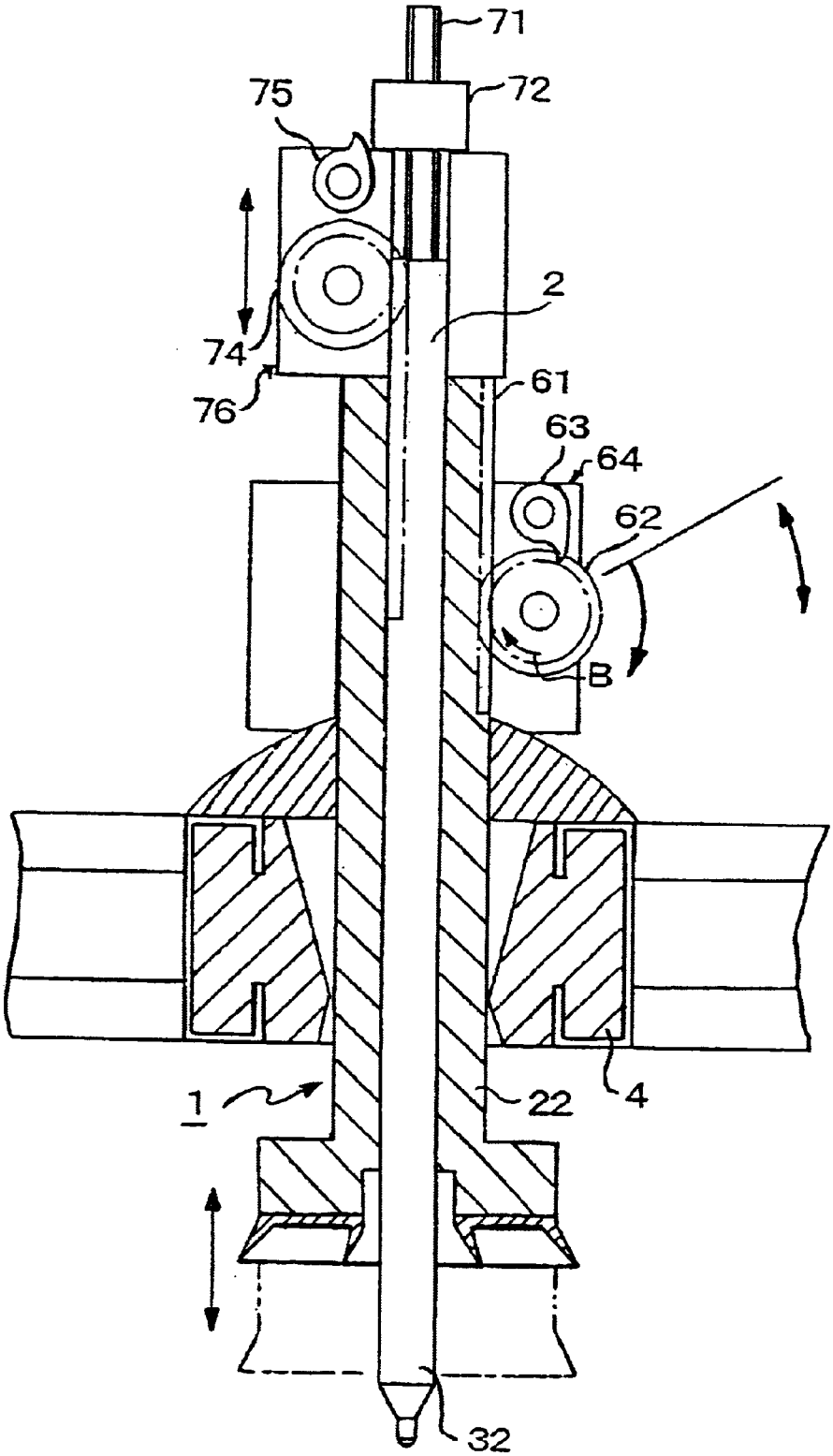
FIG. 11 is a diagram showing a condition in which only a first puller according to an embodiment of the present invention is pulled up.

As shown in FIG. 11, the first ascent/descent device 6 for raising the hollow shaft 22 by using the holding portion 4 as a fulcrum is provided in the upper portion of the hollow shaft 22, and composed of a first rack gear 61 provided on the hollow shaft 22 and extending in the axial direction thereof, a first pinion gear 62 engaged with the first rack gear 61, a first engagement pawl 63 engaged with the first pinion gear 61 and limiting the rotating direction thereof, a first ascent/descent device main body 64 containing the first pinion gear 61 and the first engagement pawl 63, and a first rotating means (not shown) capable of rotating the first pinion gear 61 in an arbitrary direction.

While in this embodiment a ratchet lever equipped with a ratchet mechanism is adopted as the first rotating means, it is also possible to adopt an electric motor or the like. A more detailed description of the first ascent/descent device 64 constructed as described above will be given below along with the description of the holding portion 4.

The second puller 3 includes a second fixing portion 31 for further locally fixing (holding) the damaged portion to be pulled up by the first puller 2, a slide rod 32 having the second fixing portion 31 at its lower end and slidably held to the interior of the hollow shaft 22 and that of the second puller through-hole 28, and a second ascent/descent device 7 for raising the slide rod 32 using the holding portion 4 or the hollow shaft 22 of the first puller 2 as a fulcrum.

As shown in FIG. 3, the second fixing portion 31 includes a positively charged metal holder main body 33, and an electrode position metal chip 34 (weld member) embedded in the forward end portion of the holder main body 33. That is, the second fixing portion 31 adopts an electrode position holder for holding the damaged portion by welding.

Then, the electrode position chip 34 is welded to the damaged portion negatively charged beforehand, and by the second fixing portion 31, the damaged portion to be pulled up by the first puller 2 can beheld further locally. The area of the damaged portion fixed by the second fixing portion 31 is sufficiently smaller than the area of the damaged portion fixed by the first fixing portion 21 of the first puller 2.

The slide rod 32 having the second fixing portion 31 at its lower end is made of metal, and its entire length is sufficiently larger than that of the hollow shaft 22. Thus, in the state in which it is inserted into the hollow shaft 22, its lower and upper end portions externally protrude from the hollow shaft 22, respectively. Then, the second ascent/descent device 7 is provided in the upper portion of the slide rod 32 protruding from the hollow shaft 22 (See FIG. 1). That is, the second ascent/descent device 7 is provided so as to be placed on the upper end of the hollow shaft 22.

Figure 10:
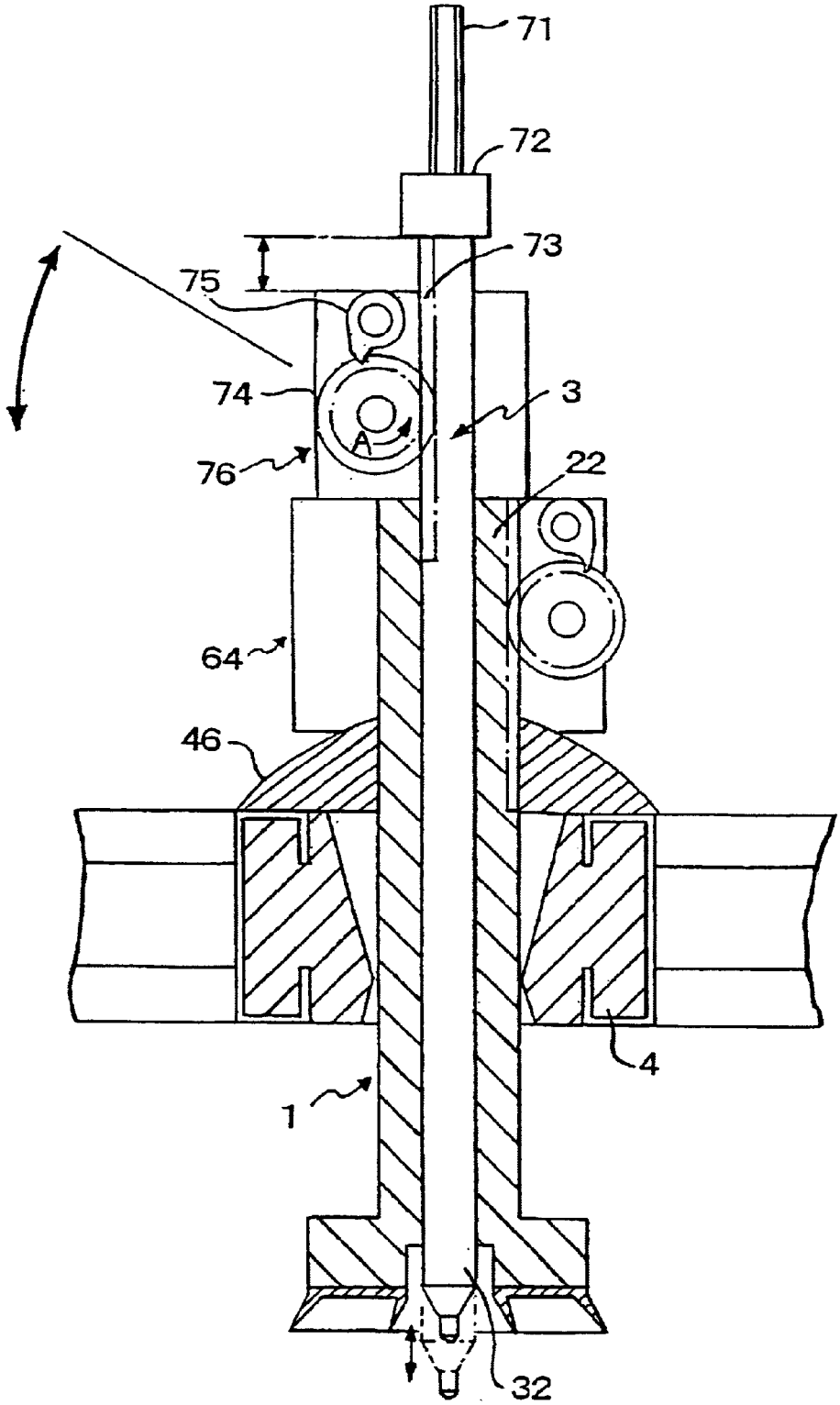
FIG. 10 is a diagram showing a condition in which only a second puller according to an embodiment of the present invention is pulled up.

As shown in FIG. 10, the second ascent/descent device 7 for pulling up the second puller 3 includes an adjust rod 71 extending axially upward from the upper end of the slide rod 32, an adjust collar 72 fitted onto the adjust rod 71, a second rack gear 73 provided on the slide rod 32 and extending in the axial direction thereof, a second pinion gear 74 engaged with the second rack gear 73, a second engagement pawl 75 engaged with the second pinion gear 74 and limiting the rotating direction thereof, a second ascent/descent device main body 76 containing the second pinion gear 74 and the second engagement pawl 75, and a second rotating means (not shown) for rotating the second pinion gear 74 in an arbitrary direction.

While in this embodiment a ratchet lever equipped with a ratchet mechanism is adopted as the second rotating means, it is also possible to adopt an electric motor or the like. A detailed description of the operating method for the second ascent/descent device 7 constructed as described above will be given below along with the description of the holding portion 4.

The puller main body 1 integrally provided with the first puller 2 and the second puller 3 is installed over the damaged portion by the holding portion 4 holding the puller main body 1 perpendicularly with respect to the damaged portion. The holding portion 4 is supported by the support device 5 capable of freely moving the holding portion 4 in plane matrix directions with respect to the damaged portion.

Figure 6:
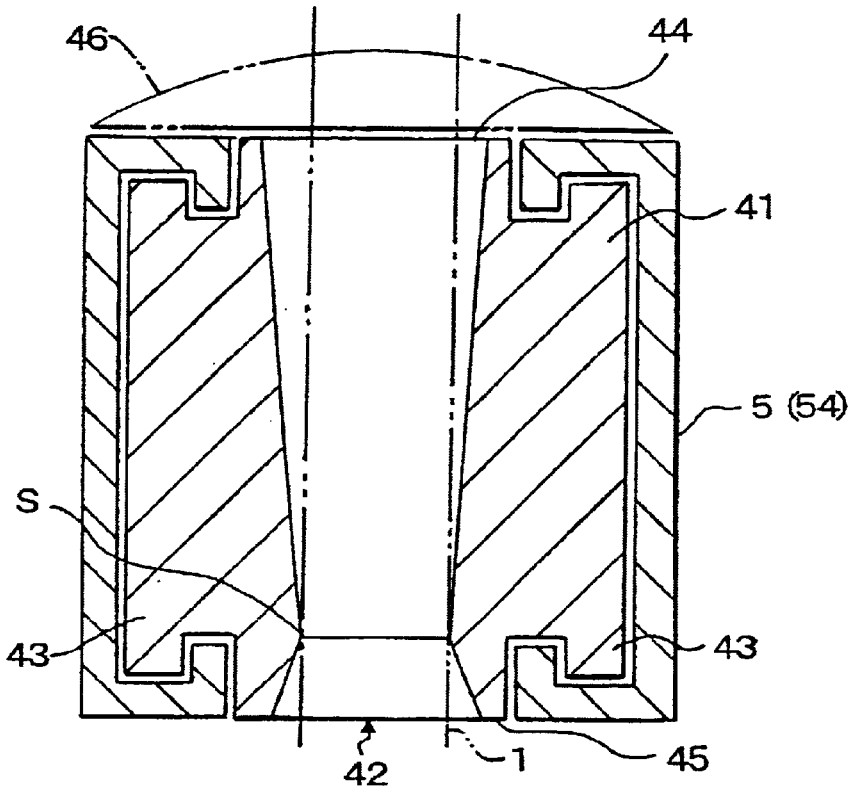
FIG. 6 is a sectional view of a holding portion according to an embodiment of the present invention.
Figure 7:
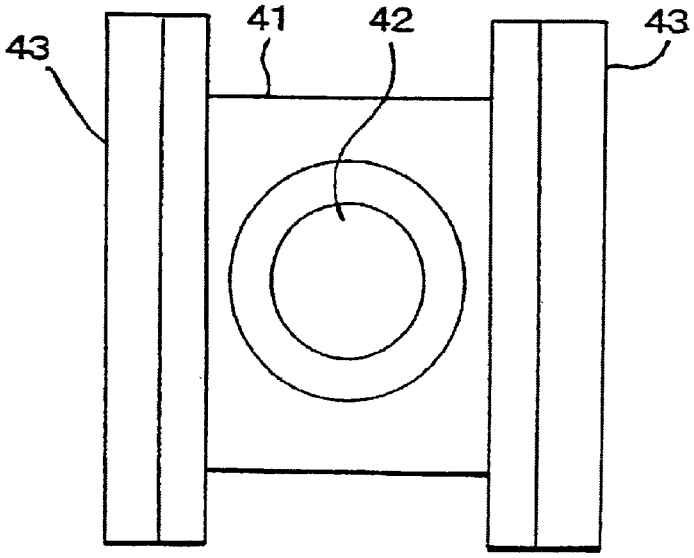
FIG. 7 is a top view of a holding portion according to an embodiment of the present invention.

As shown in FIGS. 6 and 7, the holding portion 4 includes a metal holding portion main body 41 formed substantially as a rectangular parallelepiped, a puller support hole 42 provided so as to form a communication between the upper and lower sides of the holding portion main body 41, and support device engagement portions 43 respectively provided on a pair of side wall surfaces of the holding portion main body 41, the puller main body 1 being held by the puller support hole 42. The support device engagement portions 43 are supported by the support device 5 described below, and a detailed description thereof will be given below along with the description of the support device 5.

The inner diameter of the puller support hole 42 is gradually diminished as it extends inwardly from the upper end surface 44. At a predetermined depth, the inner diameter starts to be gradually increased toward the lower end surface 45. That is, the puller support hole 42 is formed as a hand-drum-shaped hole. The portion S where the inner diameter of the puller support hole 42 is minimum (hereinafter referred to as the fulcrum S) is formed into a configuration substantially the same as the outer configuration of the hollow shaft 22, and the puller main body 1 is held by the holding portion 4 at the fulcrum S. That is, the puller main body 1 is supported at one point in the puller support hole 42. In FIG. 6, the imaginary line indicates the puller main body 1.

Thus, the puller main body 1 is held by the holding portion 4 at one point in the axial direction thereof, and one end of the puller main body can be moved in all directions by using that point as a fulcrum. That is, even if the damaged portion is an inclined surface, it is always held by the holding portion 4 in a position in which it is perpendicular to the inclined surface. However, the limit of its movement is determined by the inclination angles of the portions of the puller support hole 42 extending respectively from the end surfaces 44 and 45 to the fulcrum S.

Then, the vertical movement of the puller main body 1 with respect to the holding portion 4 is effected by the ascent/descent devices 6 and 7. Above the holding portion 4, there is provided a semispherical base plate 46. This base plate is provided so that the vector (magnitude, direction of application) of the pulling-up force of each of the ascent/descent devices 6 and 7 may always coincide with the axis of the puller main body 1 since, as described above, the puller main body 1 can be at an arbitrary angle with respect to the holding portion 4.

Figure 8:
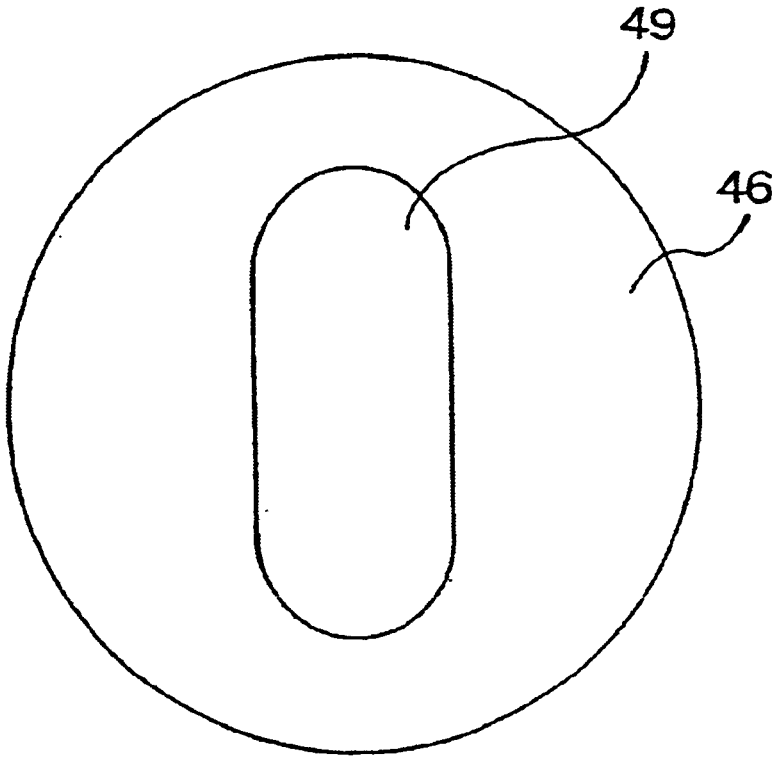
FIG. 8 is a top view of a base plate according to an embodiment of the present invention.
Figure 9:
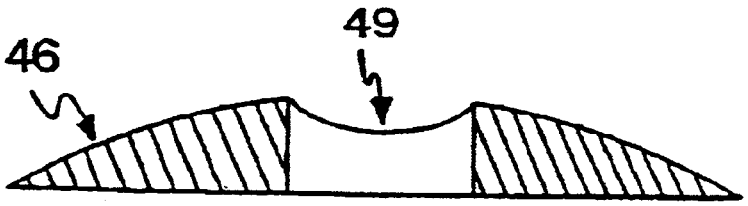
FIG. 9 is a sectional view of a base plate according to an embodiment of the present invention.

Before describing the operation method for the respective ascent/descent devices 6 and 7 and the operation of the respective pullers 2 and 3, this base plate 46 will be described. As shown in FIGS. 8 and 9, the base plate 46 is formed into a semispherical configuration with a convex upper side and a flat lower side. Further, an elongated hole 49 is provided so as to extend from the upper side to the lower side thereof. Then, the puller main body 1 is passed through this elongated hole 49. The radius of curvature of the convex surface of the base plate 46 is equal to the radius as measured from the fulcrum S to the surface of the base plate 46.

The inclination direction of the puller main body 1 appears to be restricted to one direction by this elongated hole 23. However, the base plate 46 is completely independent of the holding portion 4, so that the puller main body 1 can be inclined substantially in all directions when the base plate 46 is rotated within the range of 0 to 90 degrees with respect to the holding portion 4.

Figure 12:
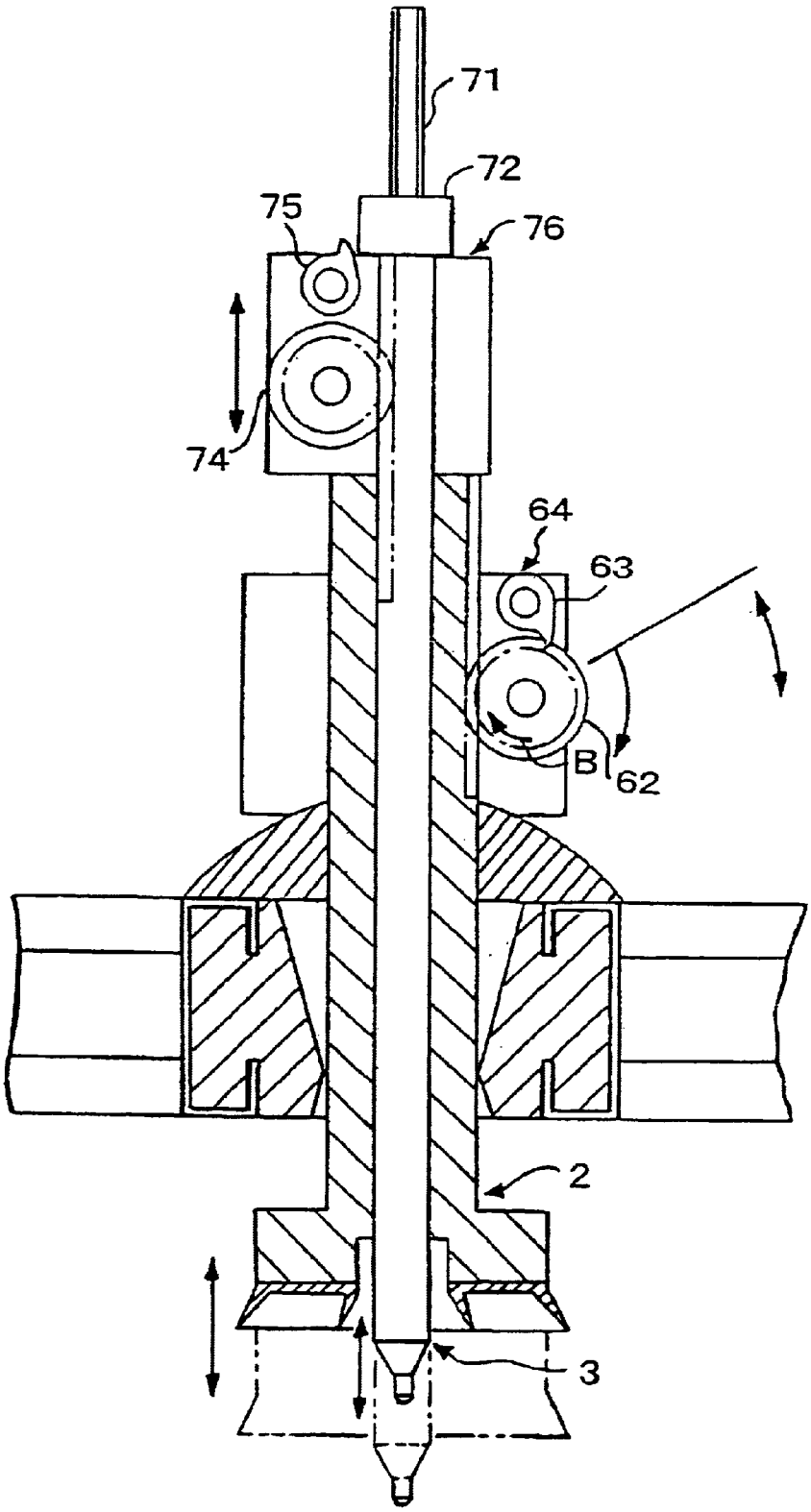
FIG. 12 is a diagram showing a condition in which first and second pullers according to an embodiment of the present invention are simultaneously pulled up.

In the following, the operation of the first puller 2 and that of the second puller 3 will be described along with the respective operation of the ascent/descent devices 6 and 7 with reference to FIGS. 10 through 12. In the description of the pullers 2 and 3, it is to be assumed that the respective fixing portions 21 and 31 of the first puller 2 and the second puller 3 are fixed to the damaged portion beforehand.

First, with reference to FIG. 10, the operation of pulling up only the second puller 3 (slide rod 32 side) will be described.

To pull up only the second puller 3, the second engagement pawl 75 provided in the second ascent/descent device 76 is engaged with the second pinion gear 74. Then, when the second pinion gear 74 is rotated in the direction of the arrow A of FIG. 10, the slide rod 32 ascends through the second rack gear 73 as a result of the rotation of the second pinion gear 74. When only the second puller 3 is pulled up, the adjust collar 72 may be fixed to any position with respect to the adjust rod 71.

Here, the fulcrum of the second ascent/descent device main body 76 is on the base plate 46. That is, the relative movement (downward movement) of the second ascent/descent device main body 76 with respect to the slide rod 32 is restricted by the first ascent/descent device main body 64, the base plate 46, and the holding portion 4. Thus, the second puller 3 (slide rod 32) ascends with respect to the second ascent/descent device main body 76. Further, since the second engagement pawl 75 is engaged with the second pinion gear 74, the second pinion gear 74 makes no reverse rotation, and the second puller 3 is held at a position corresponding to the rotation angle of the second pinion gear 74.

It is also possible to previously provide the second pinion gear 74 or the slide rod 32 with a scale for ascertaining the amount by which the second puller 3 is pulled up. In this case, when the operator operates the second ascent/descent device 7 while watching the scale, it is possible to accurately ascertain the ascent/descent amount of the second puller 3 with respect to the damaged portion. Thus, it is possible to pull out the damaged portion solely by a predetermined amount.

Next, the operation of pulling up only the first puller 2 (hollow shaft 22 side) will be described with reference to FIG. 11.

To pull up only the first puller 2, the adjust collar 72 provided above the slide rod 32 is fixed to a position close to the upper side of the adjust rod 71. Subsequently, the engagement between the second pinion gear 74 and the second engagement pawl 75 provided in the second ascent/descent device main body 76 is canceled, and the first engagement pawl provided in the first ascent/descent device main body 64 is engaged with the first pinion gear 62. Then, when the first pinion gear 62 is rotated in the direction of the arrow B of FIG. 11, the hollow shaft 22 ascends through the first rack gear 61 as a result of the rotation of the first pinion gear 62.

Here, the second ascent/descent device main body 76 is pushed upwardly by the upper end surface of the hollow shaft 22. However, since the engagement between the second pinion gear 74 and the second engagement pawl 75 has already been canceled, the second pinion gear 74 can freely move on the second rack gear 73. Thus, the slide rod 32 does not ascend with the ascent of the first puller 2. Further, in the first puller 2, the first engagement pawl 63 is engaged with the first pinion gear 62, so that the first pinion gear 62 makes no reverse rotation, and the first puller 2 (the hollow shaft 22) is held at a position corresponding to the rotation angle of the first pinion gear 62.

Here, when the fixing position of the adjust collar 72 with respect to the adjust rod 71 is varied, it is possible to previously set the amount by which the first puller 2 is pulled up with respect to the damaged portion. In this case, it is more preferable to previously provide a scale on the adjust rod 71. In FIG. 11, the adjust collar 71 is fixed to a position where the movement amount of the first puller 2 with respect to the second puller 3 is maximum.

Further, when a scale is previously provided on the hollow shaft 22 or the first pinion gear 62 as in the above case, and the operator operates the first ascent/descent device 6 while watching the scale, it is possible to accurately ascertain the amount by which the first puller 2 is pulled up with respect to the damaged portion. Thus, it is possible to pull out the damaged portion solely by a predetermined amount.

Next, the operation of simultaneously pulling up the first puller 2 (the hollow shaft 22) and the second puller 3 (the slide rod 32) will be described with reference to FIG. 12.

To simultaneously pull up the first puller 2 and the second puller 3, the engagement between the second pinion gear 74 and the second engagement pawl 75 provided in the second ascent/descent device main body 76 is first canceled, and the first engagement pawl 63 provided in the first ascent/descent device main body 64 is engaged with the first pinion gear 62. Subsequently, the adjust collar 72 provided above the second puller 3 is fixed in a state in which it is in contact with the second ascent/descent device 76. Then, when in this state the first pinion gear 62 is rotated in the direction of the arrow B of FIG. 12, the second puller 3 ascends with the ascent of the first puller 2.

More specifically, as a result of the ascent of the first puller 2, the upper end surface of the first puller 2 (the hollow shaft 22) pushes down the second ascent/descent device main body 76, and the second ascent/descent device main body 76 ascends with the first puller 2. At this time, the positioning of the second ascent/descent device 76 with respect to the slide rod 32 is effected by the adjust collar 72, so that the slide rod 32 ascends with the second ascent/descent device main body 76 through the adjust color 72. Further, since the first engagement pawl 63 is engaged with the first pinion gear 62, the first pinion gear 62 makes no reverse rotation, and the first puller 2 and the second puller 3 are held at a position corresponding to the rotation angle of the first pinion gear 62.

It is also possible to previously provide the first pinion gear 62 or the hollow shaft 22 with a scale for ascertaining the amount by which the first puller 2 is pulled up. In this case, when the operator operates the first ascent/descent device 6 while watching the scale, it is possible to accurately ascertain the pulling-up amount of the first puller 2 with respect to the damaged portion. Thus, it is possible to pull out the damaged portion solely by a predetermined amount.

Figure 2:
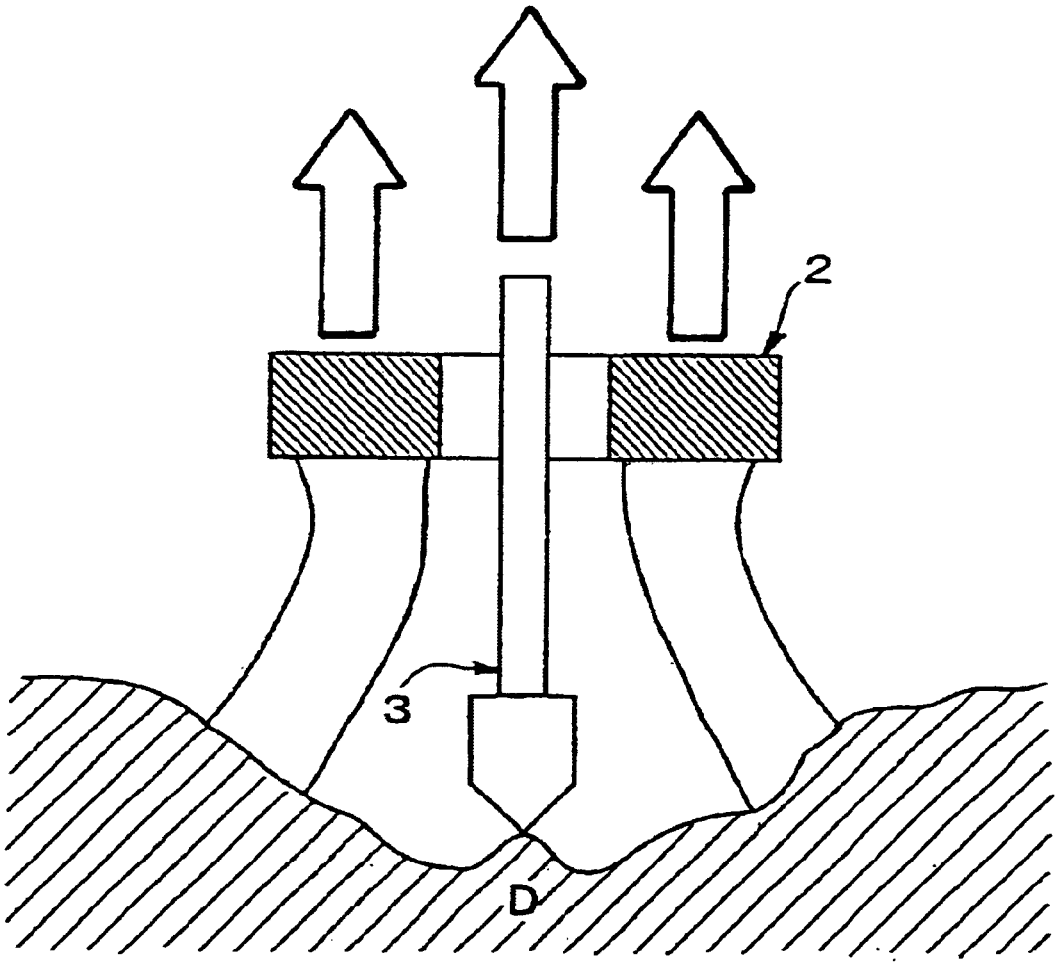
FIG. 2 is a diagram illustrating the principle of a pulling-up operation in accordance with the vehicle repairing device of the present invention.

In this way, in this embodiment, the first puller 2 and the second puller 3 can move up and down independently of each other. Thus, as shown in FIG. 2, which shows the principle of this embodiment, it is possible while pulling up damaged portion D in its entirety by the first puller 2 to further locally pull up the damaged portion D by the second puller 3.

Figure 23:
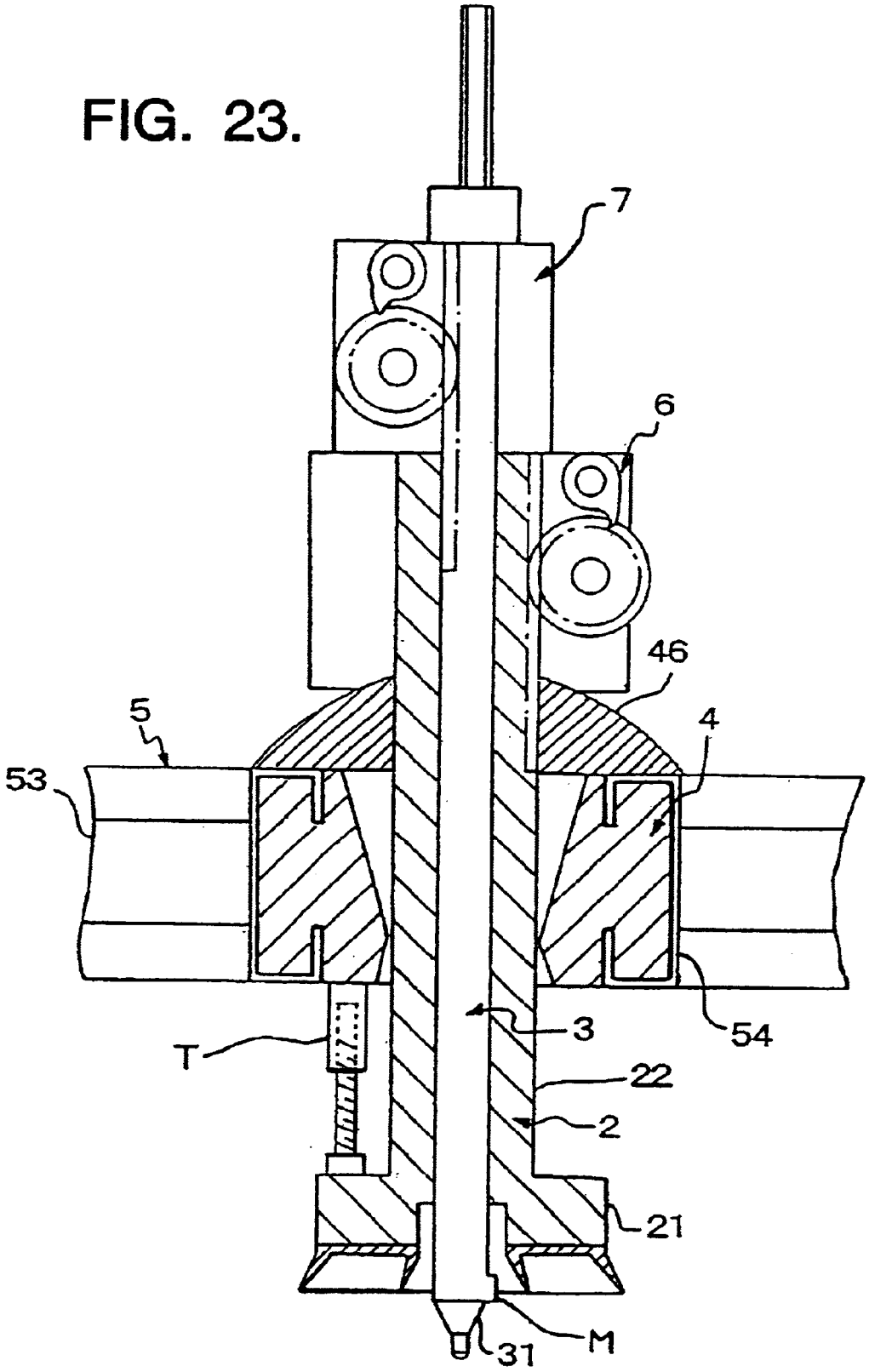
FIG. 23 is a sectional view of a vehicle repairing device according to an embodiment of the present invention.

When each component is previously provided with a scale, the operator operates each ascent/descent device while watching the scale, thereby making it possible to accurately effect pulling-up by a predetermined amount. It is also possible for the pulling-up amount of the first puller 2 and the second puller 3 to be forcibly restricted to a predetermined value. In this case, the normal panel surface position with respect to the damaged portion D of a predetermined range is set to zero point, and pulling-up can only be effected up to this zero point. For example, when, as shown in FIG. 23, there is provided on the lower end surface of the holding portion 4 a lock member T which allows length adjustment toward the main body portion 21, the first puller 2 is at the maximum pull-up position when the upper end surface of the main body portion 21 abuts the lock member T. The operator performs zero point correction by adjusting the length of the lock member T such that the lock member T abuts the upper end surface of the main body portion 21, with the lower end surface of the main body portion 21 of the first puller 2 being set onto the normal panel surface.

The maximum pull-up position for the second puller 3 is set to be of the same height as the lower end surface of the main body portion 21 of the first puller 2. That is, a protrusion M is formed on the outer surface of the slide rod 32 of the second puller 3, and the formation position for the protrusion M is set such that when the protrusion M abuts the upper end portion of the inner surface of the main body portion 21, the lower end of the second fixing portion 31 is of the same height as the lower end surface of the main body portion 21.

By thus forcibly restricting the maximum pulling-up amount of the damaged portion D, even a person who is not skilled can perform pulling-up repair operation at a plurality of positions within a predetermined range easily and reliably in a short time while sliding the holding portion 4 on a rail to a desired position (pull-up position).

Next, the support device 5, which can move the holding portion 4 holding the puller main body 1 freely in plane matrix directions with respect to the damaged portion, will be described.

The support device 5 is composed of a support frame 51 which supports the holding portion 4 so as to be capable of freely moving in planar directions with respect to the damaged portion, and a plurality of support legs 100 provided around the support frame 51.

The support frame 51 includes a pair of longitudinal rails 53 having a C-shaped sectional configuration and arranged parallel to each other, a pair of lateral rails 54 bridging the space between the longitudinal rails 53 and arranged parallel to each other, and connecting rails 55 connecting the end portion of the pair of longitudinal rails 53 to each other. While the connecting rails 55 may simply consist of bar-like members, this embodiment adopts rails having a C-shaped sectional configuration like the longitudinal rails 53, whereby the weight of the support device 5 is reduced and the number of parts is reduced, thereby achieving a reduction in production cost.

Figure 15:
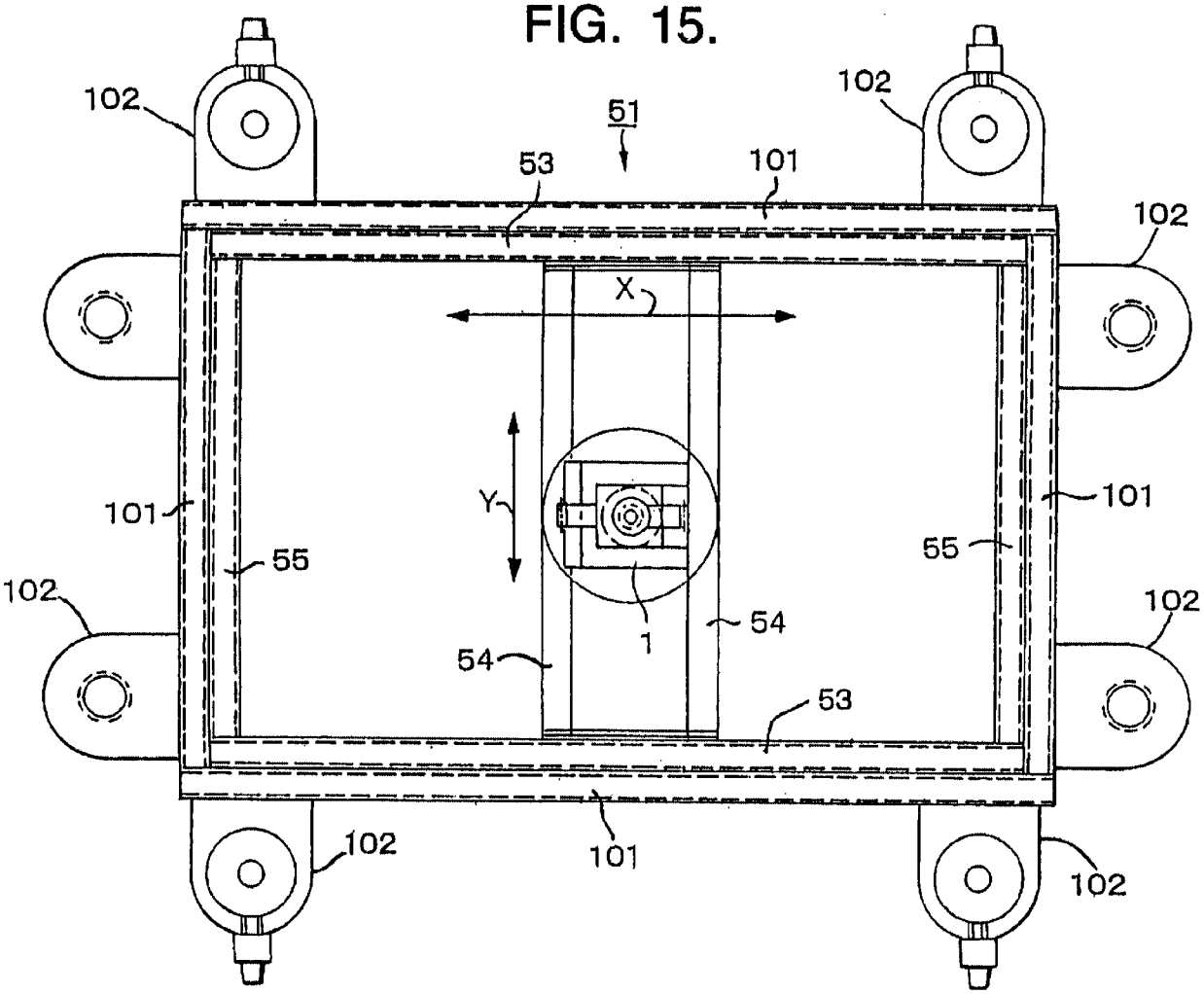
FIG. 15 is a plan view showing a support device according to an embodiment of the present invention.
Figure 18:
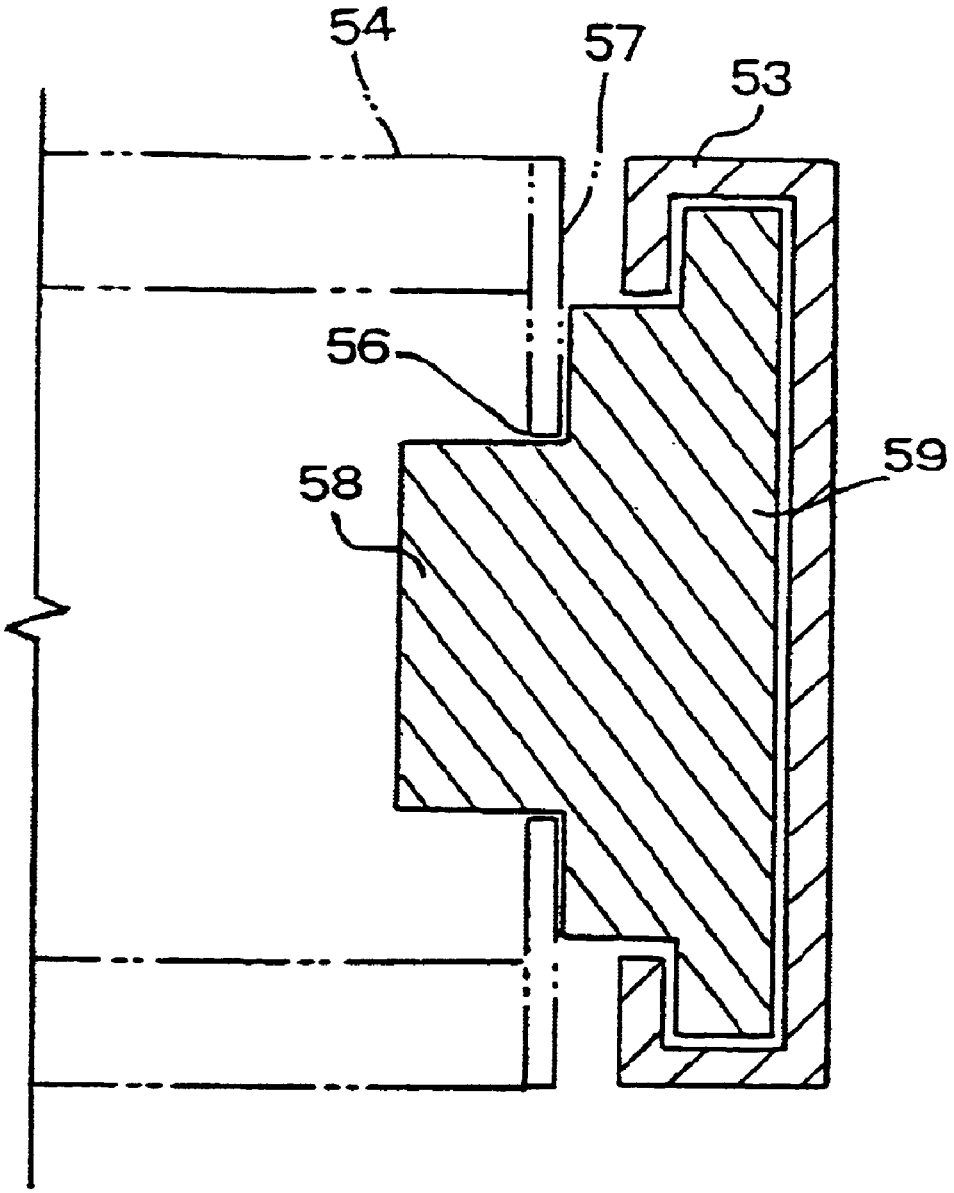
FIG. 18 is a sectional view showing a lateral rail retaining bracket according to an embodiment of the present invention.
Figure 19:
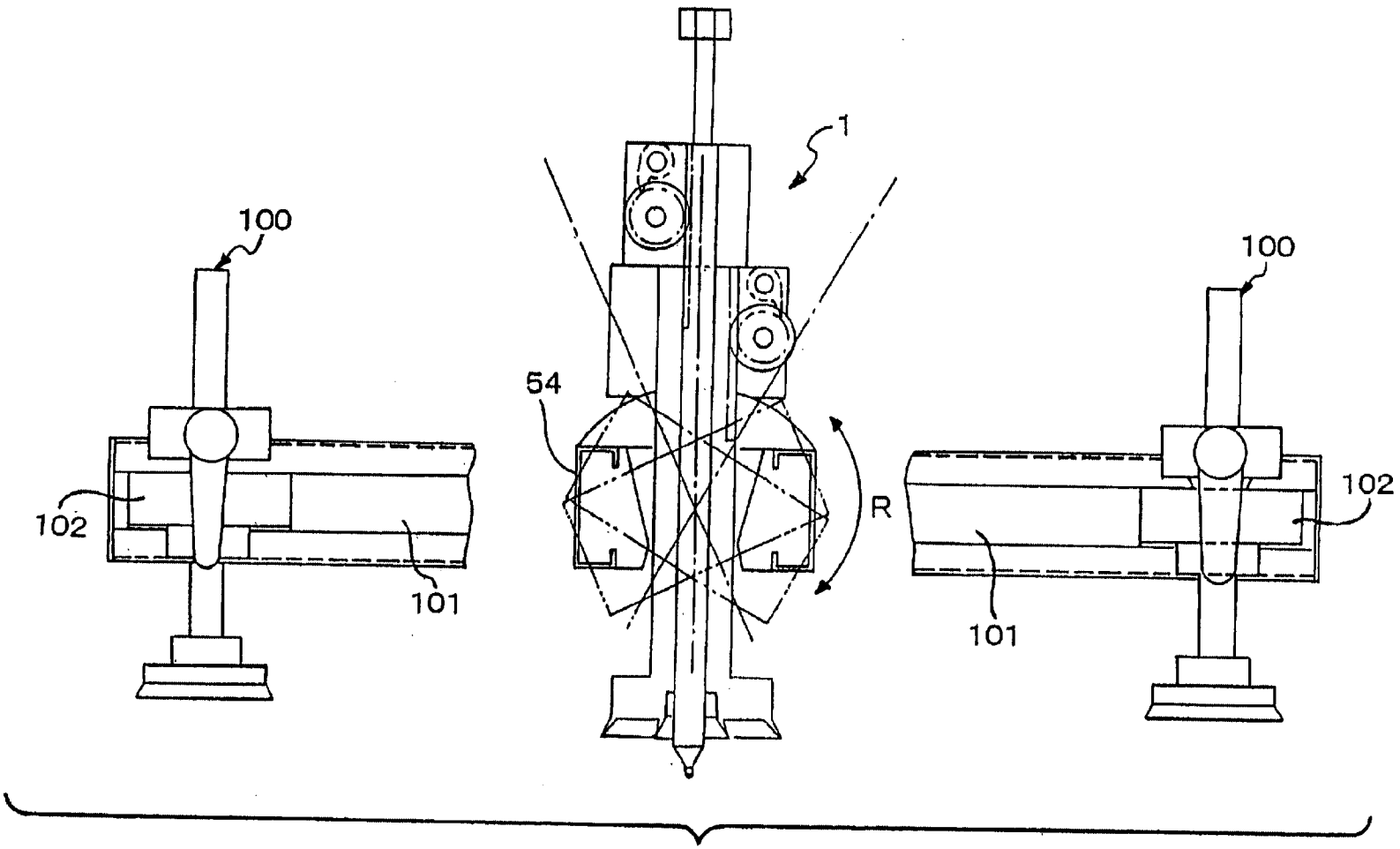
FIG. 19 is a diagram showing a condition in which a lateral rail according to an embodiment of the present invention is movable.

Further, as shown in FIGS. 16 through 18, the end portions of the lateral rails 54 are secured to bearing plates 57 each having a bearing hole 56 at its center, and, through lateral rail holding brackets 59 equipped with a rotation shaft 58 passed through the bearing holes 56, they are slidably held by the longitudinal rails 53. Thus, as shown in FIG. 15, the lateral rails 54 can slide laterally (in the direction of the arrow X) with respect to the longitudinal rails 53. Further, as shown in FIG. 19, they can rotate in the direction of the arrow R around the rotation shaft 58 provided in the lateral rail holding brackets 59.

Then, the holding portion 4 holding the puller main body 1 to the lateral rail 54 is arranged on the lateral rails 54 so as to be slidable in the direction of the arrow Y of FIG. 15. Like the longitudinal rails 53, the lateral rails 54 have a C-shaped sectional configuration, and the grooves are opposed to each other Then, these grooves opposed to each other are engaged with the support device engagement portions 43 of the holding portion 4, and the holding portion 4 is held by the support device 5 (See FIG. 6).

It is also possible to provide the longitudinal rails 53 and the lateral rails 54 with scales for ascertaining the position (coordinates) of the puller main body 1 with respect to the damaged portion. In this case, by watching the scales, the operator can correctly ascertain the position (coordinates) of the puller main body 1 with respect to the damaged portion.

As shown in FIG. 16, the support legs 100 supporting the support frame 51 are provided in the support legs 100 through the intermediation of a support leg rail 101 provided along the outer periphery of the longitudinal rails 53 and that of the connecting rails 55 and support leg holding brackets 102 slidably held in the support leg rail 101.

Figure 13:
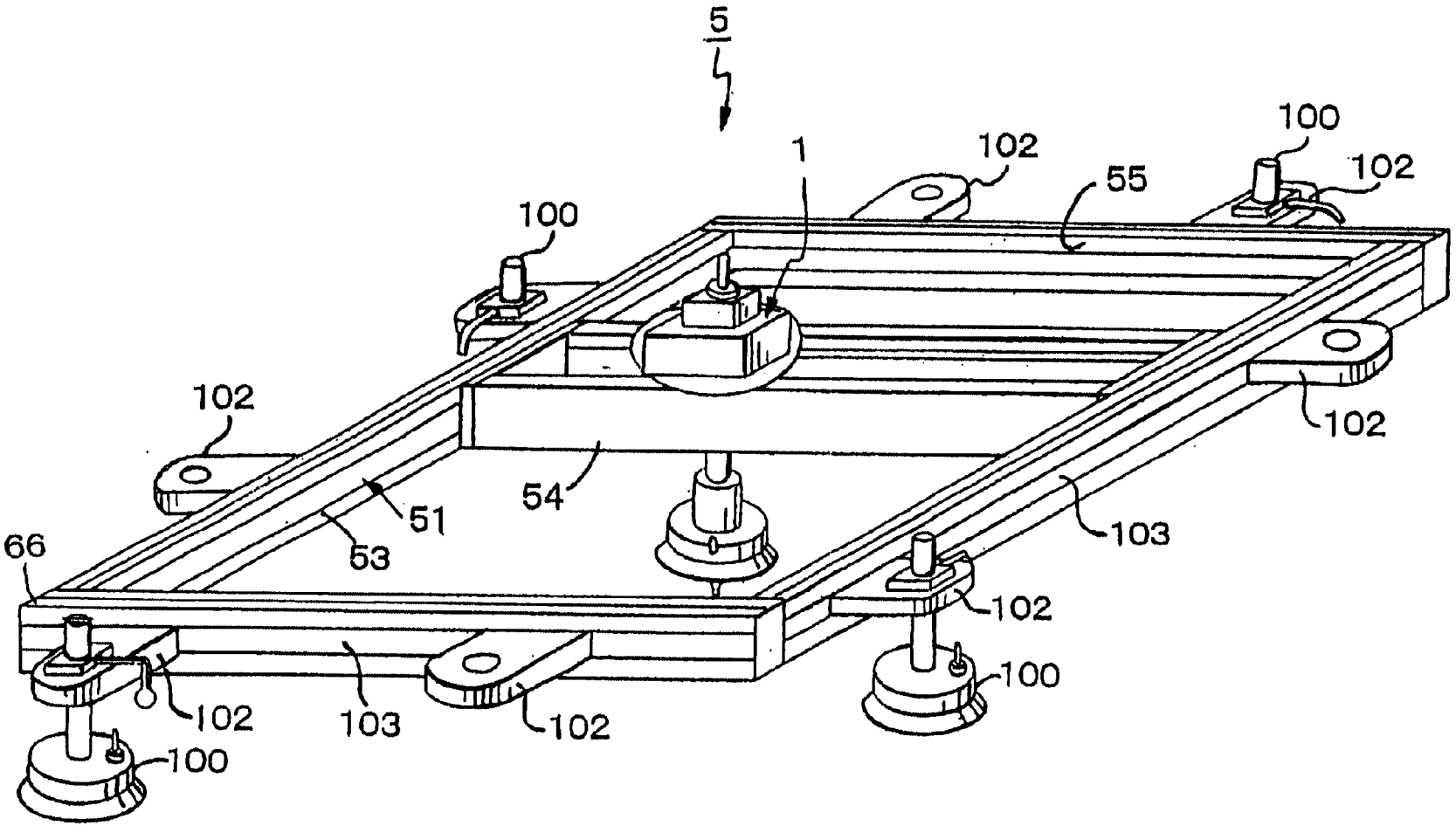
FIG. 13 is a perspective view showing a support device according to an embodiment of the present invention.
Figure 14:
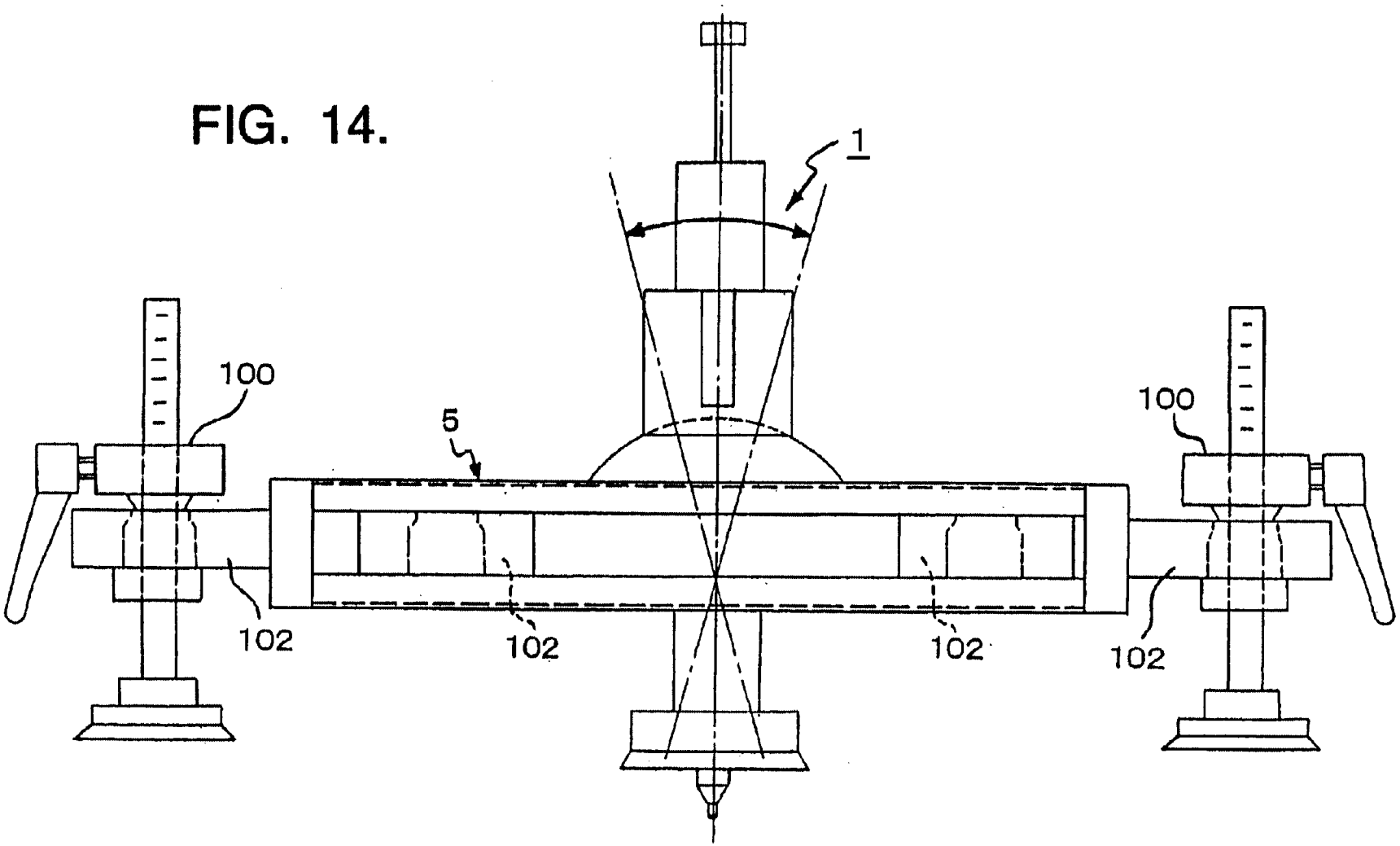
FIG. 14 is a side view showing a support device according to an embodiment of the present invention.

Like the longitudinal rails 53 and the lateral rails 54, the support leg rail 101 is a rail having a C-shaped sectional configuration and is arranged back to back with respect to the longitudinal rails 53 and the connecting rails 55. That is, a slide groove 103 for the support legs is formed newly in the outer periphery of the support frame 51 (See FIG. 13).

As shown in FIG. 15, the support frame 51 as a whole has eight support leg holding brackets 102 slidably provided in the support leg rail 101, of which two support leg holding brackets are provided on each side of the support leg rail 101. Then, for the eight support leg holding brackets 102, there are provided four support legs 100 in total. That is, when using the support device 5, the four support legs 100 are attached to appropriate ones of the support leg holding brackets 102 according to the configuration of the panel surface of the vehicle having a damaged portion. It is also possible to previously provide support legs 100 in all the support leg holding brackets 102.

Figure 20:
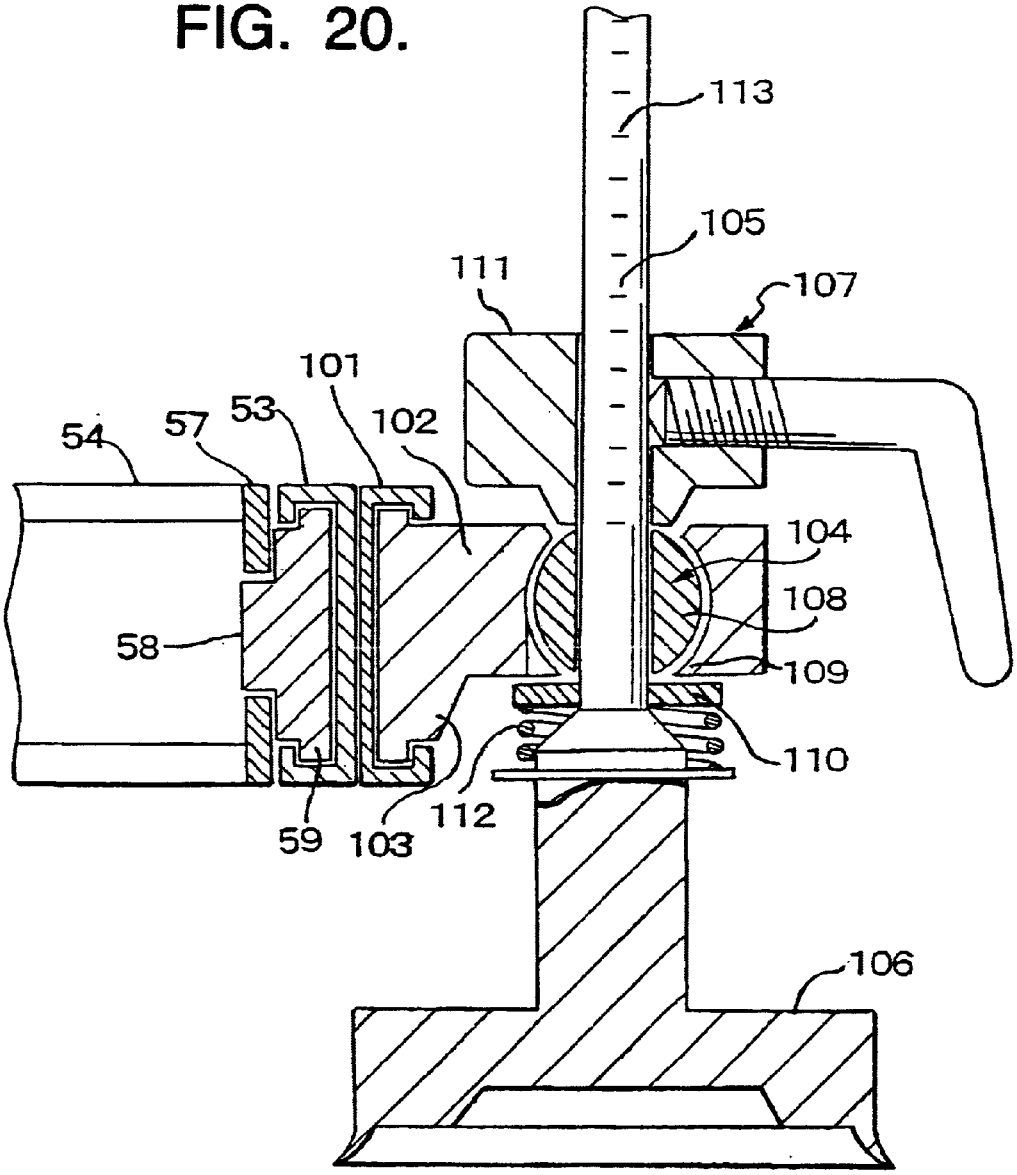
FIG. 20 is a sectional view of a support leg provided in a support device according to an embodiment of the present invention.
Figure 21:
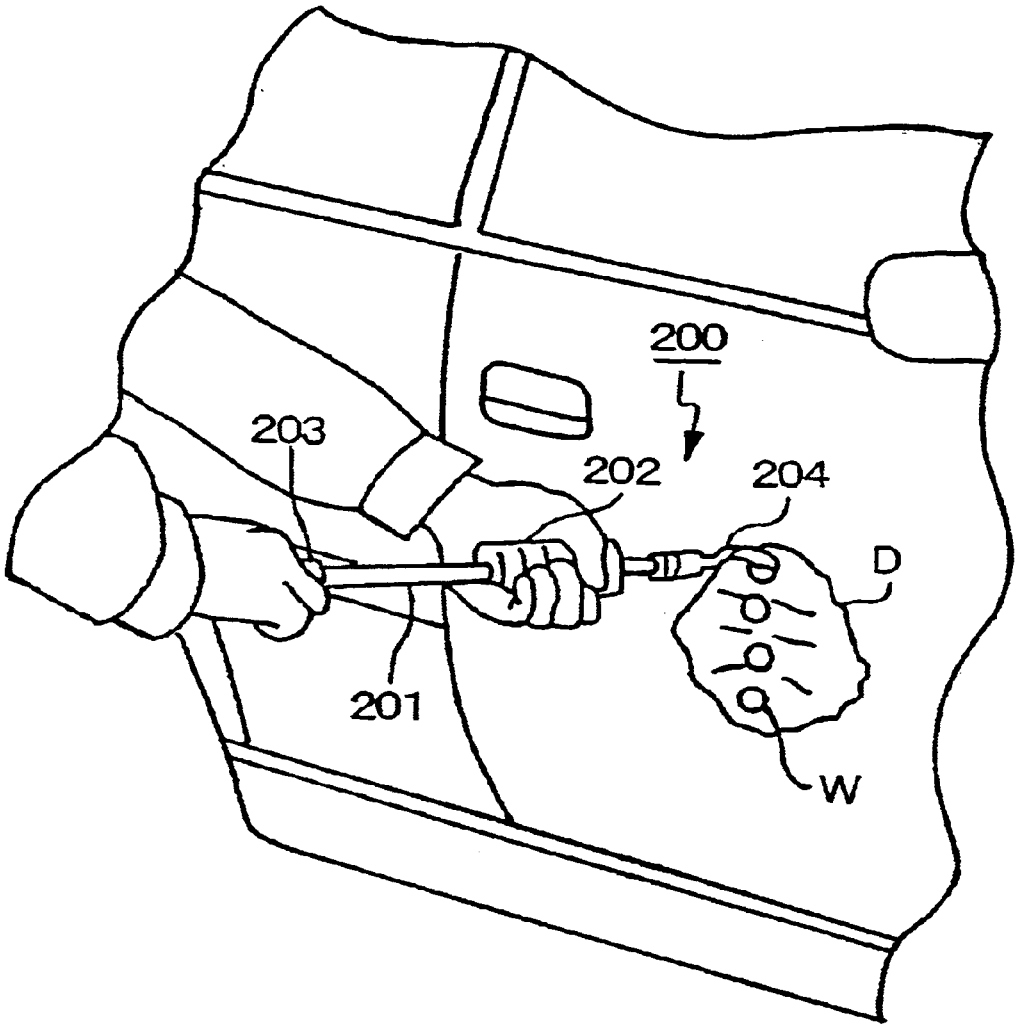
FIG. 21 is a diagram showing how a conventional sliding hammer for sheet metal repair is used.
Figures 22, 22A:
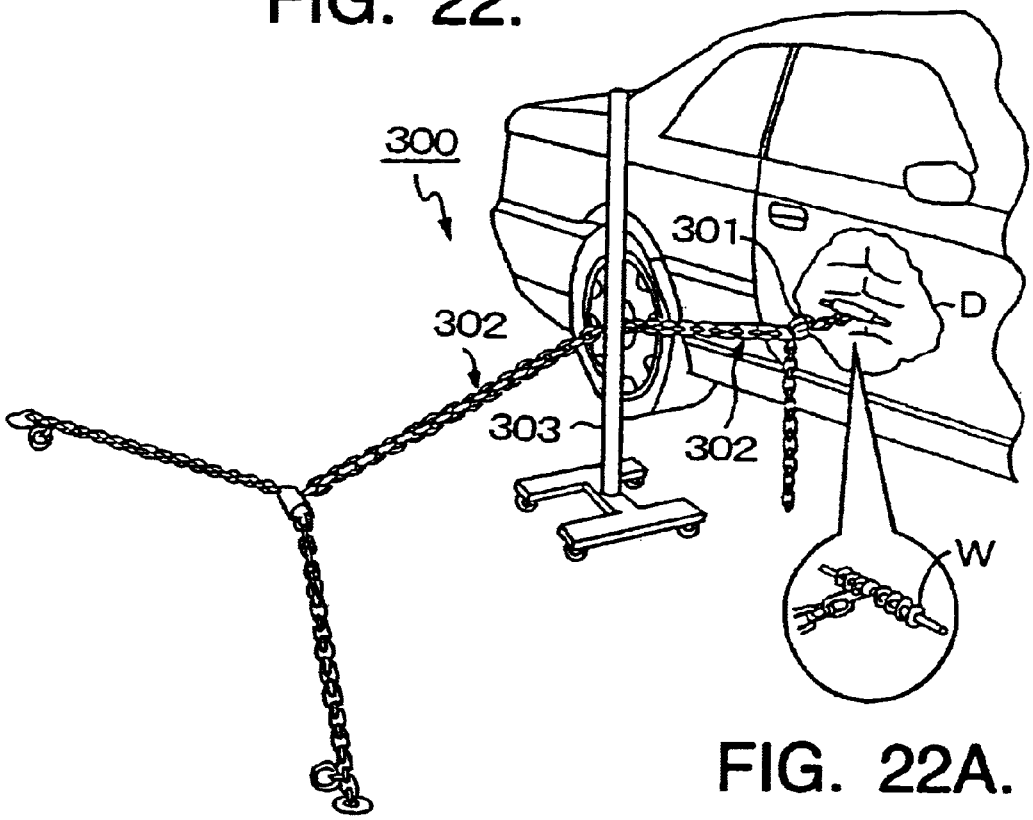
FIG. 22 is a diagram showing how a conventional power lock stand device for sheet metal repair is used.

As shown in FIG. 20, each support leg 100 fixed onto the panel surface of the vehicle through the support leg holding bracket 102 includes a leg portion 105 held by the support leg holding bracket 102 through the intermediation of a ball joint 104, a support leg fixing portion 106 provided at the lower end of the leg portion 105, and an adjuster 107 provided on the leg portion 105, the leg portion 105 being fixed to the panel surface of the vehicle by the support leg fixing portion 106. As in the above-described case, a suction device connected to a negative pressure source is used for the support leg fixing portion 106, making it possible to firmly fix the leg portion 105 to the panel surface.

Since the leg portion 105 is held by the support leg holding bracket 102 through the intermediation of the ball joint 104, the support leg 100 is always held at right angle with respect to the panel surface. The ball joint 104 includes a ball main body 108 equipped with a hole through which the support leg 100 is passed, a spacer 109 for joining the ball main body 108 to the support leg holding bracket 102, and a cover member 110 for securing the spacer 109 to the support leg bracket 102, the ball main body 108 sliding with respect to the support Leg holding bracket 102, whereby the angle of the leg portion 105 is varied.

The adjuster 107 includes an adjuster main body 111 provided above the support leg holding bracket 102, and an adjuster spring 112 provided below the support leg holding bracket 102. Then, the adjuster main body 111 is vertically moved with respect to the leg portion 105, thereby making it possible to adjust the effective length of the leg portion 105. Due to the adjuster spring 112 provided below the support leg holding bracket 102, the adjuster main body 111 and the support leg holding bracket 102 are always kept in contact with each other, whereby the height of the support frame 51 can be easily adjusted.

A scale 113 is provided on the leg portion 105. It is also possible to previously set the effective length of the leg portion 105 by this scale 113 before setting the support device 5 on the panel surface. In this case, the positioning of the support frame 51 with respect to the panel surface is facilitated.

Thus, in this embodiment, there is provided the support device 5, which supports the puller main body 1 at any angle and any position in the vicinity of the damaged portion, so that the puller main body 1 can be installed at optimum position and angle with respect to the damaged portion in the panel surface.

When a scale is provided on each component, it is possible to correctly ascertain the pulling-up amount of each puller with respect to the damaged portion and the position (coordinates) of the puller main body with respect to the damaged portion. Thus, by performing operation based on the information obtained by the scales, the operator can approximate the damaged portion to the normal configuration accurately and efficiently.

The present invention is not restricted to the above-described embodiments. Various modifications are possible for a person skilled in the art without departing from the scope of the present invention as defined by the appended claims.

What is claimed is:

1. A vehicle repairing device for pulling out a damaged portion of a panel surface to a normal position, comprising a first puller having a first fixing portion structured and arranged to be fixed to the damaged portion, said first fixing portion having an outer perimeter, said first puller being operable to pull up said first fixing portion while said first fixing portion is fixed to a predetermined region of the damaged portion bounded by said outer perimeter, and a second puller having a second fixing portion structured and arranged to be fixed to the damaged portion at a location within said outer perimeter, said second puller being operable to pull up said second fixing portion while said second fixing portion is further locally fixed to the damaged portion of the panel surface to be pulled up by said first puller.

2. A vehicle repairing device according to claim 1, wherein said first fixing portion includes an attachment pad for covering the damaged portion of the panel surface to be pulled up by said first puller, and a pressure reducing means for reducing the pressure within an interior of the attachment pad.

3. A vehicle repairing device according to claim 1, wherein said second fixing portion includes a weld member to be welded to the damaged portion of the panel surface, and a holder for holding the weld member.

4. A vehicle repairing device for pulling out a damaged portion of a panel surface to a normal position, comprising a first puller having a first fixing portion structured and arranged to be fixed to the damaged portion, said first puller being operable to pull up said first fixing portion while said first fixing portion is fixed to a predetermined region of the damaged portion, and a second puller having a second fixing portion structured and arranged to be fixed to the damaged portion, said second puller being operable to pull up said second fixing portion while said second fixing portion is further locally fixed to the damaged portion of the panel surface to be pulled up by said first puller, further comprising a puller main body equipped with a hollow shaft, a slide rod slidably provided inside said hollow shaft, a first ascent/descent device operable to pull up said hollow shaft, and a second ascent/descent device operable to pull up said slide rod, characterized in that:

said first fixing portion is provided at one end of the hollow shaft;

said second fixing portion is provided at one end of the slide rod; and said second fixing portion is provided so as to protrude into an interior of said first fixing portion.

5. A vehicle repairing device according to claim 4, further comprising a holding portion for holding said puller main body perpendicular to the damaged portion of the panel surface, wherein the holding portion holds said puller main body at one point along an axial direction thereof, and one end of said puller main body is movable in all directions by using said one point as a fulcrum about which the puller main body can pivot.

6. A vehicle repairing device according to claim 5, further comprising an ascent/descent device mounted adjacent the hollow shaft of the puller main body and operable to pull the hollow shaft up relative to the holding portion, the ascent/ descent device bearing against a surface that is fixed in the axial direction relative to the holding portion, and the hollow shaft of the puller main body extending through an aperture in said surface, said aperture being configured to permit a predetermined range of movement of the hollow shaft when the puller main body pivots about said fulcrum.

7. A vehicle repairing device according to claim 6, wherein the surface against which the ascent/descent device bears comprises a part-spherical surface having a radius of curvature equal to a distance between said surface and said fulcrum.

8. A vehicle repairing device according to claim 7, wherein the part-spherical surface is formed on a base plate disposed between the holding portion and the ascent/descent device.

9. A vehicle repairing device according to claim 4, wherein at least one of said first ascent/descent device and said second ascent/descent device includes a rack gear extending along an outer peripheral surface of said hollow shaft or said slide rod and in the axial direction thereof, a pinion gear engaged with said rack gear, an engagement pawl engaged with said pinion gear and restricting the rotating direction thereof, an ascent/descent device main body which contains said pinion gear and said engagement pawl and which is supported at a predetermined support point, and a rotating means for rotating said pinion gear.

10. A vehicle repairing device according to claim 4, further comprising a supporting device for supporting said puller main body, wherein said supporting device has a longitudinal rail and a lateral rail slidably provided on the longitudinal rail and said holding portion is slidably held by the lateral rail.

11. A vehicle repairing device according to claim 4, further comprising an adjustable stop arranged between the puller main body and the holding portion for limiting a distance by which the puller main body is pulled up relative to the holding portion.

* * * * *